US006280685B1

(12) United States Patent
Grellier et al.

(10) Patent No.: US 6,280,685 B1
(45) Date of Patent: Aug. 28, 2001

(54) TOOL STEEL COMPOSITION

(75) Inventors: André Grellier, Neuilly sur Seine; Michel Siaut, Bois Colombes, both of (FR)

(73) Assignee: Aubert & Duval (FR)

( * ) Notice: Subject to any disclaimer, the term of this patent is extended or adjusted under 35 U.S.C. 154(b) by 0 days.

(21) Appl. No.: 09/424,965

(22) PCT Filed: Mar. 30, 1999

(86) PCT No.: PCT/FR99/00735

§ 371 Date: Feb. 8, 2000

§ 102(e) Date: Feb. 8, 2000

(87) PCT Pub. No.: WO99/51788

PCT Pub. Date: Oct. 14, 1999

(30) Foreign Application Priority Data

Apr. 2, 1998 (FR) ..... 98 04122

(51) Int. Cl.[7] ..... C21D 9/00; C21D 9/18; C22C 38/22; C22C 38/24

(52) U.S. Cl. ..... 420/107; 420/109; 420/111; 148/663; 148/660; 148/334

(58) Field of Search ..... 420/107, 109, 420/111; 148/663, 660, 334

(56) References Cited

U.S. PATENT DOCUMENTS 3,928,025 12/1975 Okuno et al. .

FOREIGN PATENT DOCUMENTS 2335985 1/1974 (DE) ..... C22C/39/08
1306890 2/1973 (GB) ..... C22C/39/14
516117 * 1/1976 (JP) ..... 420/107
5534687 * 3/1980 (JP) ..... 420/107

OTHER PUBLICATIONS

Patent Abstracts of Japan, vol. 15, No. 345 (C–864), Sep. 3, 1991 and JP 03 134135 A, Hitachi Metals Ltd., Jun. 7, 1991.
Patent Abstracts of Japan, vol. 17, No. 154 (C–1040), Mar. 26, 1993 and JP 04 318148 A, Hitachi Metals Ltd., Nov. 9, 1992.

* cited by examiner

*Primary Examiner*—Deborah Yee
(74) *Attorney, Agent, or Firm*—Webb Ziesenheim Logsdon Orkin & Hanson, P.C.

(57) ABSTRACT

The invention relates to a tool steel composition comprising, expressed in weight percentage:

C 0.3%–0.4%
Cr 2.0%–4.0%
Mo 0.8%–3.0%
V 0.4%–1.0%
W 1.5%–3.0%
Co 1.0%–5.0%
Si 0 %–1.0%
Mn 0 %–1.0%
Ni 0 %–1.0% the balance being mainly constituted by iron and inevitable impurities, and also to a method of preparing the composition.

13 Claims, No Drawings

TOOL STEEL COMPOSITION

This application is a 371 of PCT/FR99/00735 filed Mar. 30, 1999.

BACKGROUND OF THE INVENTION

The present invention relates to a steel of the "3% to 5% by weight chromium" family as used for making tools that withstand heat and that work under high levels of stress, such as dies for stamping and forging, dies for wire drawing, molds for static casting or for casting under pressure, using various alloys such as alloys of aluminum, copper, or titanium.

Such steels are alloyed with chromium, molybdenum, and vanadium, elements which give them the required hot strength properties. More precisely, they are subdivided into three families of compositions having properties that are similar, such that these three families are used in the same applications. These are compositions that comprise the following alloying elements, with percentages expressed by weight:

- 5% chromium, 1.3% molybdenum, 0.5% to 1.3% vanadium, approximately; or
- 3% chromium, 3% molybdenum, 0.5% vanadium, approximately; or else
- 5% chromium, 3% molybdenum, 0.8% vanadium, approximately.

Some of those steels are specified in the AISI nomenclature in the United States under the terms H11, H12, and H13, or in the DIN nomenclature in Germany under the names W1.2343, W1.2606, and W1.2344, and they are mentioned in French standard NF A 35-590.

In use, the surface of the tooling comes into contact with materials that are heated to high temperature, for example liquid aluminum at 600° C.–750° C. or steel that is to be forged and that has been preheated to 1200° C.

Consequently, the surface of the tooling is itself raised to high temperature. As a result, temperature conditions are established within the tooling between its working portion which is subjected to heating and the remainder of the part which is cooled either by natural conditions or by forced cooling.

Under severe conditions of use implementing high surface temperatures and high levels of mechanical stress, a tool is destroyed quickly by two processes:

- the mechanical strength of material decreases smoothly with increasing temperature; and
- the material loses its initial properties which were imparted thereto by preliminary heat treatment because of the metallurgical transformations that take place under the combined effects of stresses and temperature giving rise to its mechanical strength weakening and then collapsing.

Thus, rapid or even catastrophic deterioration is observed of such tooling employed under severe conditions because the working surface softens, creeps, deforms plastically, and is subject to thermal fatigue.

SUMMARY OF THE INVENTION

The tool steel of the present invention overcomes these deficiencies and includes by weight percent 0.3–0.4 C, 2.0–4.0 Cr, 0.8–3.0 Mo, 0.4–1.0 V, 1.5–3.0W, 1.0–5.0 Co, 0–1.0 Si, 0–1.0 Mn and 0–1.0 Ni with the balance being mainly iron and inevitable impurities. The present invention further includes a method of preparing a tool steel with the aforesaid composition including steps of heating the steel to a temperature of 1020° C. to 1100° C. followed by staged quenching at temperatures of 250° C. to 320° C.

DETAILED DESCRIPTION OF THE INVENTION

In a first aspect, the present invention provides a steel composition that withstands said severe operating conditions well.

The composition of the invention comprises, in weight percentage:

C 0.3%–0.4%
Cr 2.0%–4.0%
Mo 0.8%–3.0%
V 0.4%–1.0%
W 1.5%–3.0%
Co 1.0%–5.0%
Si 0–1.0%
Mn 0–1.0%
Ni 0–1.0% the balance being mainly constituted by iron and inevitable impurities.

Preferably, the composition lies within the following ranges:

0.33%–0.37%
Cr 2.58%–3.50%
Mo 1.20%–2.20%
V 0.6%–0.9%
W 1.8%–2.6%
Co 1.5%–3.0%
Si 0.2%–0.5%
Mn 0.2%–0.5%
Ni 0–0.3%

In more particularly preferred manned, the composition of the invention has concentrations of P, Sb, Sn, and As, expressed in weight percentages, which satisfy the following relationships:

$P \leqq 0.008\%$
$Sb \leqq 0.002\%$
$Sn \leqq 0.003\%$
$As \leqq 0.005\%$ while the value given by Bruscato's relationship:

$$B=(10P+5Sb+4Sn+As)\times 0.01$$

is not greater than 0.10%.

The set of alloying elements whose actions complement one another is balanced so as to provide sufficient quenchability as is required for obtaining uniform properties throughout the thickness of parts of large size.

Carbon is the basic hardening element, and its level is adjusted so as to obtain sufficient mechanical strength while ensuring that eutectic carbides do not form during solidification because carbon concentration is too high. Its concentration in the alloy of the invention lies in the range 0.3% to 0.4% by weight, and preferably in the range 0.33% to 0.37% by weight.

Chromium and molybdenum contribute to quenchability and to hardening after quenching and tempering by forming alloyed carbides during tempering heat treatment. The concentrations of these elements must not be excessive so as to avoid excessively encouraging the formation of chromium-molybdenum carbides to the detriment of vanadium and tungsten carbides. The concentration of chromium in the alloy of the invention is 2.0% to 4.0% by weight, preferably 2.50% to 3.50% by weight, while the concentration of molybdenum is 0.8% to 3.0% by weight, and preferably 1.20% to 2.20% by weight.

Vanadium contributes to hardening during tempering treatment by forming specific carbides, thereby making it possible to increase structural resistance to heating, and thus to raise the highest acceptable operating temperatures. An excess of this element is prejudicial to toughness because eutectic carbides are formed on solidification, and because of the segregating nature of this element. Its concentration in the alloy of the invention is 0.4% to 1.0% by weight, and preferably 0.6% to 0.9% by weight.

Similarly, tungsten complements the action of vanadium by mechanisms of the same type and thereby contribute to raising the temperatures which are compatible with use, and in the same manner, excess tungsten is prejudicial to toughness and to structural uniformity. Its concentration in the alloy of the invention is 1.5% to 3.0% by weight, and preferably 1.8% to 2.6% by weight.

It is the complementary and appropriately balanced effects of these four carbide-generating elements Cr, Mo, V, and W that impart new properties to the alloy of the invention.

Cobalt improves mechanical strength when hot. Its concentration in the alloy of the invention is 1.0% to 5.0% by weight, and preferably 1.5% to 3.0% by weight.

The concentrations of silicon and of manganese in the alloy of the invention are each 0% to 1.0% by weight, and preferably 0.20% to 0.50% by weight. The concentration of nickel in the alloy of the invention is 0% to 1.0% by weight, and preferably 0% to 0.30% by weight.

More generally, although there is no desire to be tied to any particular theory, it is believed that the obtention of good characteristics for such steels depends on balancing the elements of the alloy; it is the result of the individual properties of each of the elements, and also of the way they interact.

The effect of tungsten stems from the formation of carbides, with this element contributing to the composition thereof. It is in competition with chromium and molybdenum, given that a predominance of chromium carbides is harmful for stability in operation.

Nevertheless, the crystallographic nature of the carbides formed depending on the steel is still poorly known at present, and the effects of these carbides on the properties and the structural stability are known only in broad outline.

The steel of the invention is made using the methods applicable to the usual materials referred to.

The invention also provides a method of preparing tool steel having the above-defined composition, and in which, in a particular implementation, an appropriate tempering treatment is performed prior to the heat treatment of use, so as to obtain a metallographic structure that presents carbides which are fine and well distributed.

In a particular implementation, quenching is performed by heating the part to a temperature lying in the range 1020° C. to 1100° C., and preferably in the range 1040° C. to 1070° C., and then cooling by stepped quenching to 250° C. to 320° C. by any appropriate means.

In a particular implementation, the desired properties are obtained after performing two tempering treatments after quenching, the first tempering treatment being performed in the temperature range 550° C. to 580° C., and the second in the range 580° C. to 680° C. with adjustment as a function of the desired hardness in use.

In another particular implementation of the method of the invention, starting from metal produced by a conventional steelmaking method, remelting is performed by means of a consumable electrode under a vacuum or by means of a consumable electrode under slag, thereby giving the material improved inclusion properties and improved chemical uniformity, which has the effect of increasing its toughness properties and consequently its strength in operation.

The invention is described below by means of the following examples.

EXAMPLES

A test cast of a steel A of the invention having the composition given in the table below was made in order to perform various tests:

C 0.354%
Cr 3.09%
Mo 1.36%
V 0.81%
W 2.26%
Co 2.00%
Si 0.31%
Mn 0.30%
Ni 0.08%
P 0.007% the balance being constituted by iron and inevitable impurities.

The various reference materials used for testing were 5% chromium steels containing varying quantities of molybdenum and vanadium.

The symbols used below have the following meanings:

$R_m$: maximum strength;
$R_{p0.2}$: conventional elastic limit at 0.2%;
HRC: Rockwell hardness.

Example 1—Hot Traction Tests

These tests were performed at various temperatures on steel A of the invention, and on three other conventional grades of 5% chromium steel containing molybdenum and vanadium. The results are given in Table 1 below.

TABLE 1

| Material | Test temperature (° C.) | $R_m$ (MPa) | $R_{p0.2}$ (MPa) | Intended hardness (HRC) |
|---|---|---|---|---|
| A | 520 | 1092 | 916 | 46 |
| 5Cr 1.3Mo 0.5V | | 1088 | 851 | |
| A | 550 | 918 | 753 | |
| 5Cr 1.3Mo 0.5V | | 916 | 709 | 42 |
| 5Cr 3Mo 0.5V | | 842 | 664 | |
| 5Cr 1.5Mo 1V | | 901 | 702 | |
| A | 560 | 1028 | 830 | 46 |
| 5Cr 1.3Mo 0.5v | | 979 | 710 | |
| A | 600 | 955 | 745 | 46 |
| 5Cr 1.3Mo 0.5V | | 796 | 552 | |

Compared with the reference materials, it can be seen that hot strength as described by the traction test is improved, in particular for operating temperatures in excess of 550° C.

Example 2—Hot Traction Tests after being Maintained at Temperature

These tests were performed at a temperature of 550° C. after being maintained at 550° C. for 50 hours, and they were performed on steel A of the invention and also on the three other grades described above in Example 1. The results are shown in Table 2 below.

TABLE 2

| Material | Test temperature (° C.) | $\Delta R_m$ (MPa) | $\Delta R_{p0.2}$ (MPa) | Intended hardness (HRC) |
|---|---|---|---|---|
| A | 550 | −15 | −13 | 42 |
| 5Cr 1.3Mo 0.5V | | −50 | −40 | 42 |
| 5Cr 3Mo 0.5V | | −18 | −41 | 42 |
| 5Cr 1.5Mo 1V | | −101 | −104 | 42 |

In the same manner, it can be seen that the hot strength as described by the traction test is less reduced by prolonged maintenance at the operating temperature (for 50 hours) with the steel of the invention as compared with the reference steels.

Example 3—Rupture Testing under Stress

These tests were performed on steel A of the invention, and also on another grade of steel having 5% chromium, 1.2% molybdenum, and 0.5% vanadium, and the purpose of the test was to determine the stress required to cause the test pieces to rupture after 100 hours. The results are given in Table 3 below.

TABLE 3

| Material | Test temperature (° C.) | Stress (MPa) | Treated for (HRC) |
|---|---|---|---|
| A | 520 | 695 | 42 |
| | 560 | 555 | |
| | 600 | 360 | |
| A | 520 | 795 | 46 |
| | 560 | 610 | |
| | 600 | 400 | |
| 5Cr 1.2Mo 0.5V | 520 | 670 | 46 |
| | 560 | 420 | |

TABLE 3-continued

| Material | Test temperature (° C.) | Stress (MPa) | Treated for (HRC) |
|---|---|---|---|
| | 600 | 195 | |
| 5Cr 1.2Mo 0.5V | 520 | 795 | 50 |
| | 560 | 425 | |
| | 600 | 188 | |

In the same manner as before, it can be seen that the creep strength expressed as the stress which leads to rupture in 100 hours is greater for the steel of the invention.

Example 4—Deformation Tests under Stress

These tests were performed on steel A of the invention, and also on the same grade of steel as was used in Example 3, and the tests were intended to determine the stress required to obtain 1% deformation of the test pieces in 100 hours. The results are given in Table 4 below

TABLE 4

| Material | Test temperature (° C.) | Stress (MPa) | Treated for (HRC) |
|---|---|---|---|
| A | 560 | 500 | 42 |
| A | 560 | 640 | 46 |
| 5Cr 1.2Mo 0.5V | 560 | 350 | 46 |
| 5Cr 1.2Mo 0.5V | 560 | 370 | 50 |

In the same manner as before, it can be seen that the creep strength expressed as the stress which leads to 1% deformation in 100 hours is better for the steel of the invention.

Naturally, the embodiments of the tool steel composition of the invention that are described above are given purely by way of non-limiting indication, and numerous modifications can easily be provided by the person skilled in the art without thereby going beyond the ambit of the invention.

What is claimed is:

1. A tool steel composition for making tools that withstand heat and that work under high levels of stress, said tool steel containing a set of alloying elements which is balanced so as to provide sufficient quenchability for obtaining uniform properties throughout the thickness of parts of large size comprising in weight percentage:

a) carbon as a basic hardening element in the range of 0.33 to 0.37%, b) complementary hardening elements chromium and molybdenum in the ranges of:
Cr 2.0%–4.0%
Mo 1.2%–2.2% such that said tool steel does not include a preponderance of chromium carbides which are harmful for stability in operation, c) complementary hardening elements vanadium and tungsten are present in the ranges of:
V 0.4%–1.0%
W 1.5%–3.0% which provides for increasing structural resistance to heating and for raising the highest acceptable operating temperatures, and d) the following elements in the following ranges:

Co 1.0%–5.0%

Si 0%–1.0%

Mn 0%–1.0%

Ni 0%–1.0% the balance being mainly constituted by iron and inevitable impurities.

2. A tool steel composition according to claim 1, comprising:

Cr 2.58%–3.50%

V 0.60%–0.90%.

3. A tool steel composition according to claim 1, wherein the concentrations in said composition of P, Sb, Sn, and As, expressed in weight percentages satisfy the following relationships:

$P \leqq 0.008\%$ $Sb \leqq 0.002\%$ $Sn \leqq 0.003\%$ $As \leqq 0.005\%$ while the value given by Bruscato's relationship:

$$B=(10P+5Sb+4Sn+As)\times 0.01$$

is not greater than 0.10%.

4. A tool steel composition according to claim 1, comprising 1.8% to 2.6% by weight of tungsten.

5. A tool steel composition according to claim 1, comprising 1.5% to 3.0% by weight of cobalt.

6. A tool steel composition according to claim 1, comprising 0.20% to 0.50% by weight of silicon.

7. A tool steel composition according to claim 1, comprising 0.20% to 0.50% by weight of manganese.

8. A tool steel composition according to claim 1, comprising at least 0.30% by weight of nickel.

9. A method of preparing a tool steel having the composition according to claim 1, the method including a quenching operation comprising:

heating the steel to temperatures lying in the range 1020° C. to 1100° C.; and staged quenching at temperatures lying in the range 250° C. to 320° C.

10. A method according to claim 9, wherein the quenching operation comprises:

heating the steel to temperatures lying in the range 1040° C. to 1070° C.; and staged quenching at temperatures lying in the range 250° C. to 320° C.

11. A method according to claim 9 wherein the steel is subjected to tempering at temperatures lying in the range 550° C. to 580° C., after the quenching operation.

12. A method according to claim 11, wherein the steel is subjected to second tempering at temperatures lying in the range 580° C. to 680° C., after the first tempering.

13. A method of preparing a tool steel of the composition according to claim 1, including a step of remelting metal by a consumable electrode under a vacuum or by a consumable electrode under slag.

* * * * *

UNITED STATES PATENT AND TRADEMARK OFFICE

CERTIFICATE OF CORRECTION

PATENT NO. : 6,280,685 B1
DATED : August 28, 2001
INVENTOR(S) : André Grellier et al.

It is certified that error appears in the above-identified patent and that said Letters Patent is hereby corrected as shown below:

Column 2,
Line 1, "1.5-3.0W" should read -- 1.5-3.0 W --.
Line 32, before "0.33%" insert -- C --.

Column 3,
Line 58, "present," should read -- present; --.

Column 5,
Table 1, first column, row 8, "0.5v" should read -- 0.5V --.

Column 8, claim 11,
Line 20, after "according to claim 9" insert comma (,).

Signed and Sealed this

Fifth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,280,685 B1
DATED : August 28, 2001
INVENTOR(S) : André Grellier et al.

It is certified that error appears in the above-identified patent and that said Letters Patent is hereby corrected as shown below:

Column 8,
Line 4, "at least" should read -- less than --.

Signed and Sealed this

Twenty-fourth Day of December, 2002

JAMES E. ROGAN
*Director of the United States Patent and Trademark Office*